US005363833A

United States Patent [19]

Messud

[11] Patent Number: 5,363,833

[45] Date of Patent: Nov. 15, 1994

[54] LEG-LOADING SPEAR GUN

[76] Inventor: Paul Messud, 24 Woralul Street, Warramanga, ACT 2611, Australia

[21] Appl. No.: 39,170

[22] PCT Filed: Oct. 4, 1991

[86] PCT No.: PCT/AU91/00456

§ 371 Date: Apr. 15, 1993

§ 102(e) Date: Apr. 15, 1993

[87] PCT Pub. No.: WO92/07229

PCT Pub. Date: Apr. 30, 1992

[30] Foreign Application Priority Data

Oct. 15, 1990 [AU] Australia ..... PK2801

[51] Int. Cl.[5] ..... F41B 7/04

[52] U.S. Cl. ..... 124/26; 124/21

[58] Field of Search ..... 124/16, 17, 21, 22, 124/26, 27, 35.1, 40; 43/6

[56] References Cited

U.S. PATENT DOCUMENTS

| | | | |
|---|---|---|---|
| 2,267,163 | 12/1941 | Moser | 124/17 |
| 2,856,912 | 10/1958 | Erickson | 124/27 |
| 3,006,330 | 10/1961 | De Bach | 124/22 |
| 3,656,252 | 4/1972 | Sherman | 124/27 X |
| 3,857,379 | 12/1974 | Burghardt . | |
| 3,949,731 | 4/1976 | Caso | 43/6 X |
| 4,318,389 | 3/1982 | Kiss, Jr. | 124/22 |

FOREIGN PATENT DOCUMENTS

| | | |
|---|---|---|
| 157206 | 4/1954 | Australia . |
| 212121 | 1/1958 | Australia . |
| 0428344 | 5/1991 | European Pat. Off. . |
| 2272363 | 12/1975 | France . |
| 270537 | 5/1970 | U.S.S.R. . |
| 987364 | 1/1983 | U.S.S.R. . |

*Primary Examiner*—Randolph A. Reese
*Assistant Examiner*—John Ricci
*Attorney, Agent, or Firm*—Foley & Lardner

[57] ABSTRACT

A spear-gun is disclosed which can be loaded by holding the butt end in the hands and moving a slider forwards with the feet to extend a spring. This allows a person of given strength to more easily load the gun or to store more energy in the spring than would be possible with a conventional arm-loaded gun. The gun comprises a barrel (32) with a pistol-grip (30) at the butt end and a head (34) adapted to guide the spear. The spring comprises two rubbers (36) arranged on either side of the barrel and aligned with its axis, the forward ends of the rubbers being connected to a forward slider (40) adapted to slide on the barrel and the rear ends being connected to a rear slider (42) also adapted to slide on the barrel. The forward slider (40) is fitted with releasable non-return dogs (47) that normally prevent it from moving rearwards along the barrel, while the rear slider (42) is adapted to be retained by trigger-operated catches (43). The gun is operated by manually releasing nonreturn dogs (47) and moving both sliders (40 and 42) and the rubbers (36) rearwards until the rear slider (42) is engaged by trigger catches (43). The butt (30) of the gun is then grasped by the hands and foot stops (46) on forward slider (40) are engaged by the feet and moved forward to extend the rubbers (36). The spear is then placed in position with its butt engaging a socket (44) on rear slider (42). The gun is aimed and the trigger operated to release catches (43) and the rear slider (40) to effect the discharge of the spear.

16 Claims, 4 Drawing Sheets

LEG-LOADING SPEAR GUN

TECHNICAL FIELD

This invention relates to spear guns and similar hand-held projectile launchers which are loaded by storing human energy in spring means and, which upon firing, transfer the energy from the spring means to the projectile. The invention also includes methods for loading such projectile launchers.

For the sake of simplicity of description and without prejudice or limitation, projectile launchers of the type with which this invention is concerned will be referred to as spear guns and the projectiles will be referred to as a spears. Such guns will be assumed to have the general configuration of a long-barrelled hand-gun in which the barrel is used to counter the force of the spring means and to align or guide the projectile as it is launched from the head or forward end of the barrel. The butt or rear end of the barrel is normally fitted with a pistol-like hand grip and trigger mechanism. As it is assumed that the gun will normally be held horizontally, the terms 'upper' and 'lower' will be used accordingly. Finally, as the spring means of such guns are usually extensible rubber or elastomeric strips commonly referred to as 'rubbers', this term will also be used.

These terms are only used for the convenience of description, as the projectile may be a ball or bolt, the spring means may be pneumatic or coil springs, and the gun need not include a pistol-style hand grip nor be confined to horizontal use.

BACKGROUND TO THE INVENTION

Spear-guns of the general type indicated are well known. They typically employ rubbers which lie along the sides and top of the barrel and which are anchored at their forward ends to lugs on the top of the head of the barrel. The rear ends of the rubbers are joined together by a U-shape wire sling. To load such a spear-gun, a spear is first threaded rearward through a guide tube (formed in an upwards extension of the barrel head) so as to lie on top of the barrel, the butt end of the spear having a first notch for engagement with the trigger mechanism and a second notch—forward of the first—for engagement with the wire sling. Then, the spear is engaged with the trigger mechanism and the sling is drawn rearwards (against the tension of the rubbers) until it can be engaged with arid retained by the corresponding notch in the spear.

To fire, the gun is held by the pistol-grip, the barrel is pointed at a target and the trigger mechanism operated to release the spear which is then driven along the barrel and through the guide tube in the head by the sling and the rubbers, the spear, rubbers and guide tube being essentially in the same plane. To maximise the energy imparted to the spear, strong rubbers are used, but these require great strength to draw and, when they are at full-stretch, it is difficult for a user to properly and quickly engage the sling in its notch on the spear. Unless engagement is effected quickly, the arms of the person loading the gun will become exhausted and rubbers must be allowed to return to their relaxed position until re-loading can be attempted. As such a gun cannot be loaded in stages, the strength of the rubbers is normally chosen so that the gun can be readily loaded by an average person under water, thus greatly restricting it potential range.

The accuracy of the conventional spear gun—particularly one that uses strong rubbers—is badly affected by the asymmetrical forces on the barrel. Because the force of the rubbers acts approximately on the axis of the spear and not the barrel, the extended rubbers bend the ends of the barrel of a loaded gun upwards. When the gun is fired, the front end of the barrel will therefore whip downwards upon release of the rubber tension, throwing the spear off-course. Furthermore, because the spear is retained against the force of the rubbers by the engagement of a catch in the trigger mechanism with a small notch in the rear end of its narrow shaft, loaded guns of this type are prone to accidental discharge. Finally, it will be seen that conventional spear guns are inconvenient to load, particularly if they have long barrels, because of the need to thread the butt end of the spear through the guide tube in the head of the barrel.

OBJECTIVE OF THE INVENTION

The present invention seeks to provide an improved spear gun and loading method which will be free of one or more of the above-mentioned problems associated with conventional spear guns.

OUTLINE OF THE INVENTION

This invention is based upon the realisation that a spear gun would be easier to load, or its range could be increased, if the muscles of the legs and back of the user could be utilised (as well as those of the arms), and that this could be achieved by arranging for one end of the spring means to be moved forwards by the feet of the user while the other is linked to the projectile through the trigger mechanism.

Thus, according to one aspect of the invention, the forward end of the spring means is anchored to a front slider which slides on or in the barrel and foot-stops are provided on the slider so that it can be moved forward by the feet to extend the spring means and load the gun, releasable non-return means being provided to prevent the rearward movement of the slider. The slider may comprise a sleeve that slides over and along the barrel, it may telescope with the barrel, or it may slide within a split barrel.

The gun may include a rear slider in addition to the front slider, the rear slider being adapted to be engaged by catches operated by the trigger mechanism and having a socket or the like to locate the butt of the spear, the spear being retained in the socket by a sprung detent that is released upon firing. The two sliders may be independently movable with respect to the barrel and linked together by the spring means. It is preferable for the catches, the non-return means and the spring means all to be in the same plane as the axis of the barrel so that no moment or torque is exerted on the sliders or on the barrel when the spring means are extended.

To operate such a gun, the slider(s) and the spring means are moved rearwards until the rear slider is engaged by the catches of the trigger mechanism, the front slider is pushed forward by the feet so as to extend the spring means and load the gun, a spear is laid on the barrel with its butt located by the rear slider, the gun is aimed and the trigger mechanism is operated to release the rear slider to discharge the spear from the front of the gun.

The trigger mechanism for retaining and releasing the rear slider may include opposing movable catches located within the rear end of the barrel to engage corresponding apertures formed in the tubular rear slider as it is moved to the rear of the barrel, and may include a spring-loaded plunger arranged for axial movement by the trigger within the barrel, the plunger being adapted to hold the dogs in their extended positions (to retain the rear slider) and to be operable by the trigger to allow the dogs to be moved to their retracted positions (thereby releasing the rear slider).

From another aspect, the present invention comprises a spear gun having a short tubular spear guide, located on the top of the head of the barrel or on op of the front slider, through which the spear is discharged and by which it is guided from the gun. The spear guide is characterised in that its upper face is obliquely slotted in such a manner that the shaft of a spear may be entered into the guide by first laying it in the slot and then moving it into line with the guide and the barrel. The guide may project upwardly from the end of the barrel, or it may be carded by the front slider.

DESCRIPTION OF EXAMPLES

Having broadly portrayed the nature of the present invention, three examples or embodiments will be described by way of illustration only. In the following description, reference will be made to the accompanying drawings in which.

EXAMPLE 1

Figure 1:
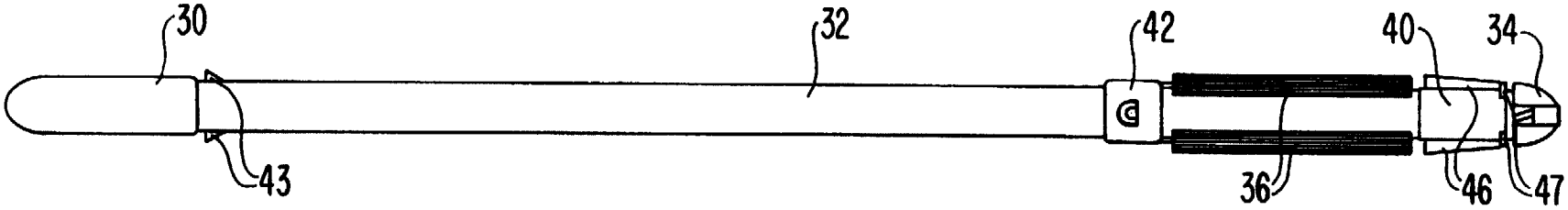
FIG. 1 is a plan view of a spear gun of the first example of this invention, shown immediately after firing.
Figure 2:
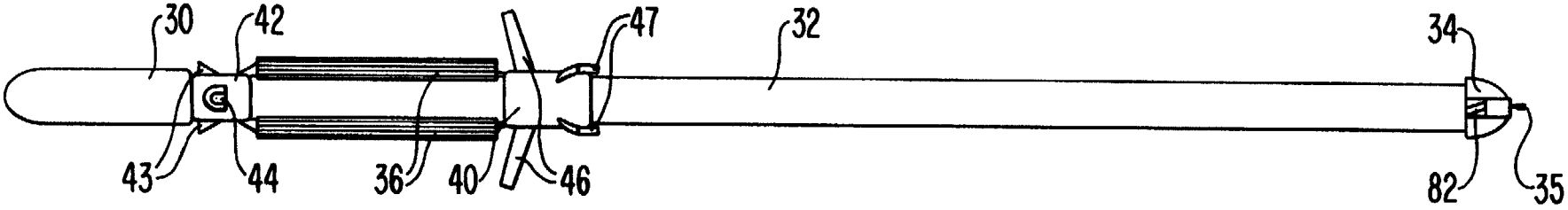
FIG. 2 is a plan view of the gun of FIG. 1, shown ready for loading.
Figure 3:
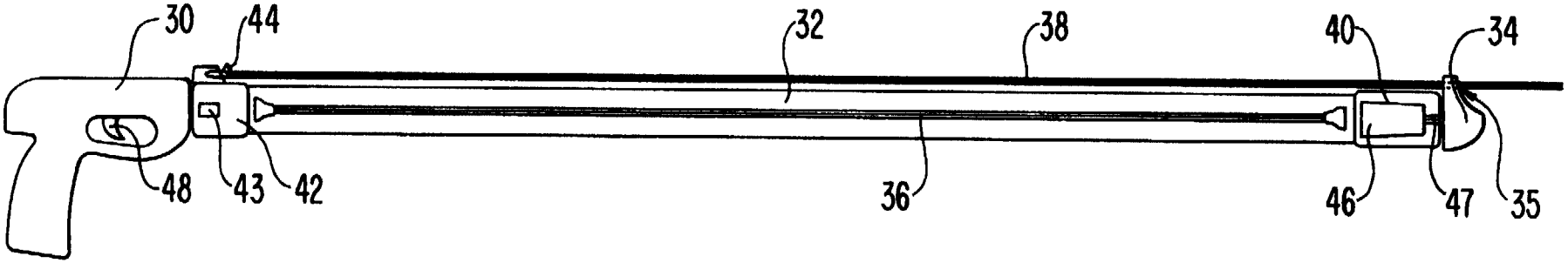
FIG. 3 is a side elevation of the gun of FIG. 1, shown fully loaded.
Figure 5A:
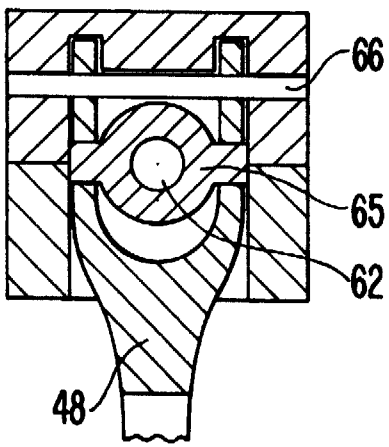
FIG. 5A is a transverse section of the trigger mechanism taken on plane 5A—5A of FIG. 5.

Referring to FIGS. 1 to 3, which are general views depicting the first example of this invention, the spear-gun of this example basically comprises a pistol grip 30, a barrel 32 fitted with a head 34 in which a spear guide-tube 35 is formed, a pair of rubbers 36, front slider 40 and rear slider 42. When loaded (FIG. 3), the butt end of a spear 38 is located in a socket 44 (FIG. 2) formed on the top of rear slider 42. Rubbers 36 are arranged on either side of barrel 32 in the plane of its axis and join sliders 40 and 42 together. When moved fully rearwards (as in FIGS. 2 and 3), rear slider 42 is engaged by a pair of catches 43 that protrude sideways from the butt end of barrel 32 and can be released by operation of a trigger mechanism housed in pistol grip 30. The forward slider 40 is fitted with a pair of folding foot-stops 46 that can be extended sideways, as shown in FIG. 2, or folded against the sides of the slider body, as shown in FIGS. 1 and 3. It also carries a pair of pawls 47 (one on each side) to engage barrel 32 and prevent slider 40 from moving rearwards along the barrel, unless they are manually released. Pawls 47 thus serve as a releasable non-return mechanism operable between barrel 32 and forward slider 40.

In the unloaded condition and immediately after the gun has been fired, forward slider 40, rubbers 36 and rear slider 42 will all be at the head end of barrel 32, as shown in FIG. 1. To load the gun, pawls 47 on slider 40 are disengaged from the barrel and both sliders are moved rearwards together with rubbers 36 until rear slider 42 is engaged and held by catches 43, whereupon, pawls 47 are released and foot-stops 46 folded outwards (the resultant condition of the gun being as shown in FIG. 2). It may, however, be preferred to release pawls 47 before rear slider 42 engages catches 43 when, say, forward slider 40 is approximately in the centre of the barrel. The remaining rearward movement of slider 42 will thus be accomplished by partially extending rubbers 36 and, therefore, partially loading the gun by the use of the arms of the operator. In either case, the rubbers are then fully extended by engaging footstops 46 with the feet while holding pistol-grip 30 firmly with both hands, and, by straightening the legs and back of the operator to push slider 40 forwards along the barrel as far as desired, slider 40 being prevented from returning under the force of rubbers 36 by the engagement of pawls 47 with the sides of barrel 32. Once forward slider 40 has been positioned, its foot-stops 46 can again be folded away onto its sides in the position indicated in FIGS. 1 and 3.

At any stage during the above-described loading process (but preferably at the end), spear 38 can be entered through guide tube 35 and engaged with socket 44 on rear slider 42 so that, upon completion of loading, the fully-loaded gun will appear as in FIG. 3. To fire the gun, trigger 48 is pulled to release side catches 43 that hold rear slider 42 which is snapped forward along the barrel by rubbers 36, thereby driving spear 38 from the gun. After firing, the condition of the gun will again be as shown in FIG. 1.

A leg-loading spear gun of this type can readily be loaded with a force of 120 kg, whereas it would be difficult to load an equivalent conventional gun to more than 40 kg. Moreover, because rubbers 36, pawls 47 and catches 43 can all be arranged in the plane of the axis of barrel 32, no bending couple is exerted on the barrel of the gun of this example when it is fully loaded so that it will be inherently more accurate than the guns of known design. It will also be appreciated that, as the force of the rubbers is held by two substantial catches (43) rather than by a single small notch in the shaft of the spear (as with conventional guns) the danger of unintentional discharge and hair-trigger operation can be readily avoided.

Figure 4A:
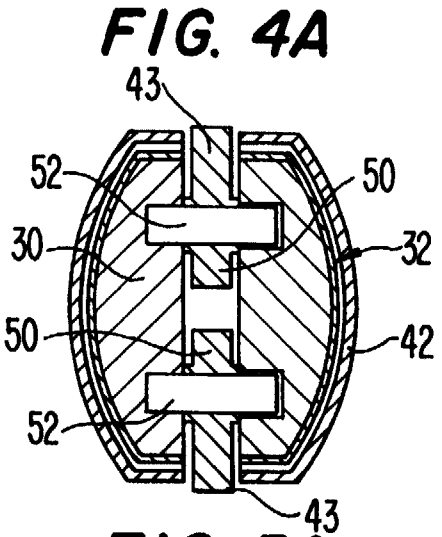
FIG. 4A is a transverse section of the mechanism of FIG. 4 taken along plane 4A—4A of FIG. 4.
Figure 4:
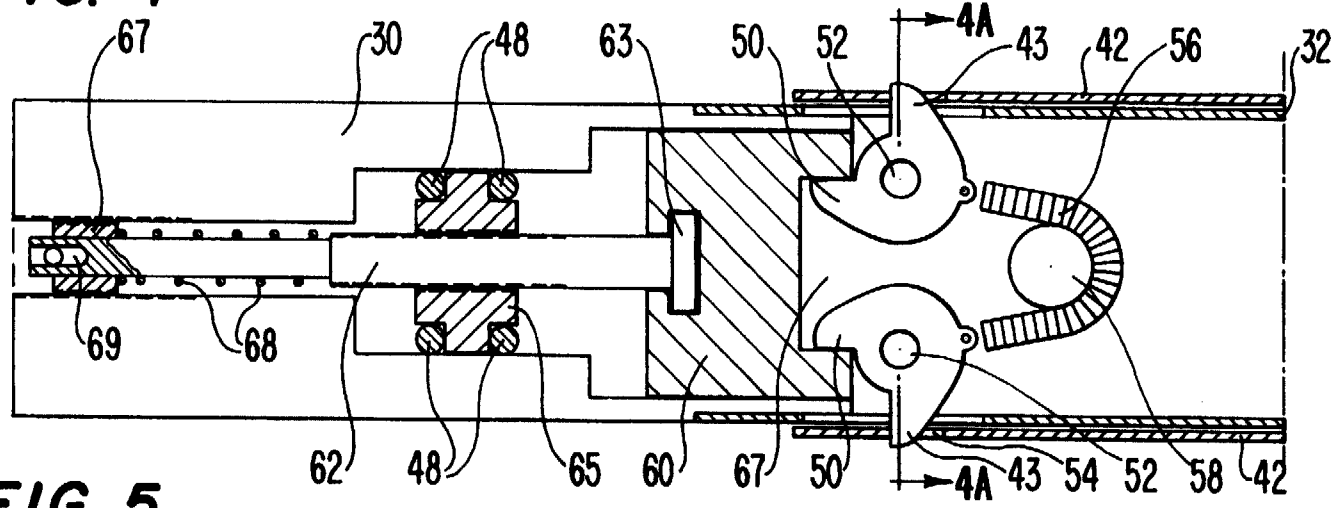
FIG. 4 is a longitudinal sectional plan of the trigger mechanism of the gun of FIG. 1.
Figure 5:
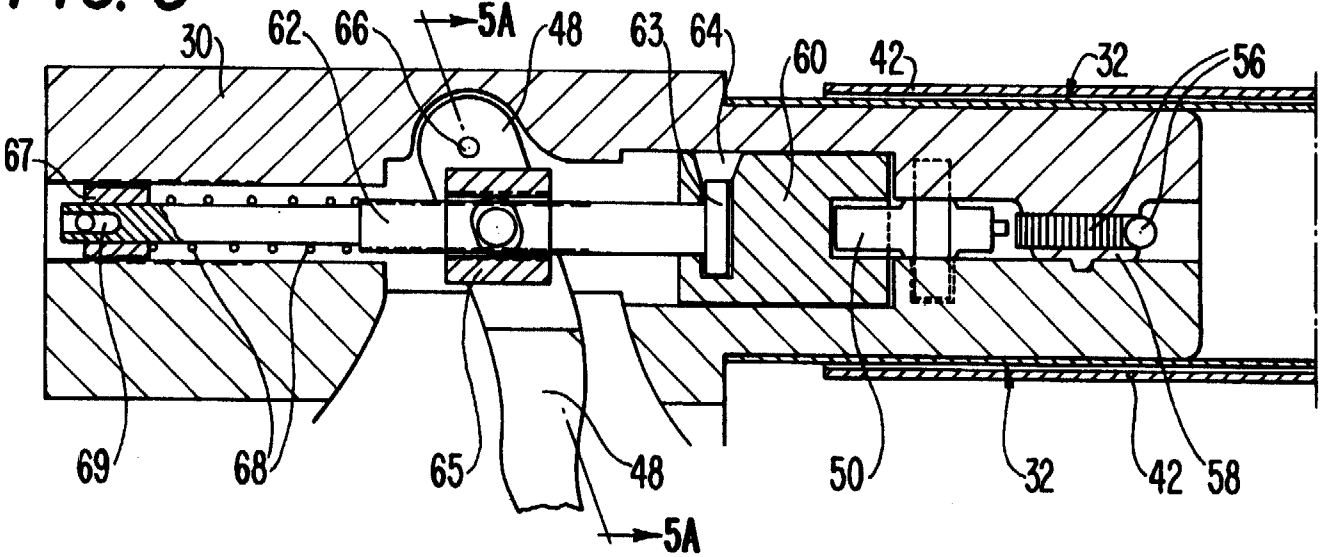
FIG. 5 is a longitudinal elevational section of the trigger mechanism of FIG. 4.

FIGS. 4 and 5 illustrate a trigger mechanism suited for use in the gun of FIGS. 1–3. It will be seen that each side catch 43 is a tooth formed on a horizontally-disposed, heart-shape dog 50 pivoted on a vertical pin 52 that is mounted in the forward end of pistol grip 30 and located within the rear end of barrel 32. Teeth 43 engage with slots 54 in the sides of slider 42, being biased to extend outwardly from the barrel by a single spring 56 that passes around a central post 58 and is attached at either end to the centre of a dog 50. As will be most clearly seen from FIG. 4, dogs 50 are prevented from rotating on their pins 52 to release slider 42, by a fork 60 mounted for to slide axially in the body of grip 30. The axial movement of fork 60 is controlled by a cylindrical pull-rod 62 which has an enlarged cylindrical head 63 that fits with a slot 64 in the rear end of fork 60. Pull-rod 62 extends axially and rearward from fork 60 and is externally threaded for screw-engagement with a trunnion block 65 carded by the trigger 48, block 65 moving with trigger 48 as it is swung around pivot pin 66 while at the same time maintaining alignment with pull-rod 62.

The rear portion of pull-rod 62 is unthreaded and reduced in diameter to slide within a smooth bore formed in an adjustment nut 67 that is threaded into an axial bore formed in the body of pistol-grip 30. A compression spring 68 is fitted around the rear portion of pull-rod 62 and bears against nut 67 to bias pull-rod 62 and trigger 48 forwards, the degree of bias being determined by the degree to which nut 67 is screwed into the bore in the pistol-grip 30. The angle of the trigger can be adjusted independently of its forward bias by rotating pull-rod 62 in trunnion block 65, rotation being effected by the insertion of an Allen-key in socket 69 in the rear end of pull-rod 62. It will be seen that, with the gun loaded (as illustrated in FIG. 3), a pull on trigger 48 will move pull-rod 62 rearwards against spring 68, drawing fork 60 rearwards to allow dogs 50 to rotate against spring 56 under the forward thrust of rear slider 42, thereby causing the retraction of teeth 43 and, therefore, the release of slider 42.

Figure 6A:
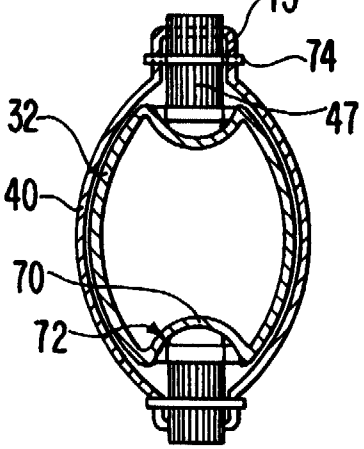
FIG. 6A is a transverse section of the barrel and slider of FIG. 6 taken along section 6A—6A of that Figure.
Figure 6:
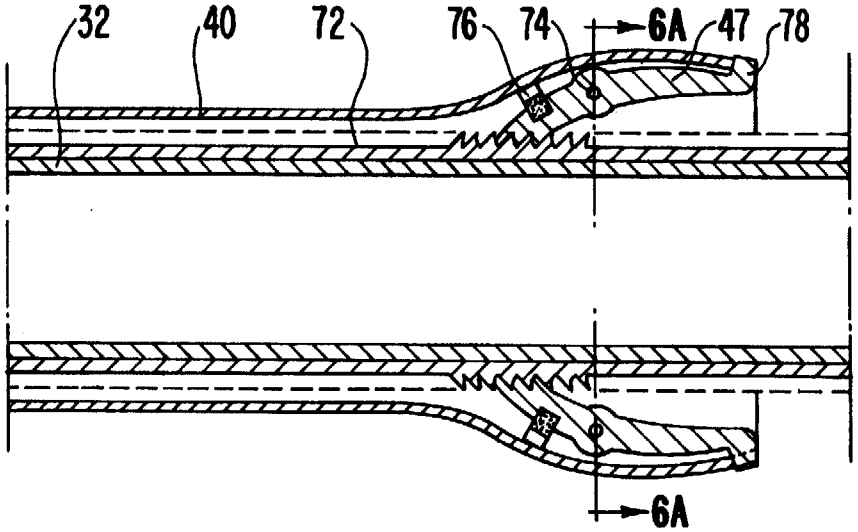
FIG. 6 is a longitudinal elevational section of the barrel and front slider of the gun of FIG. 1.

FIGS. 6 and 6A illustrate a releasable non-return mechanism suitable for use with front slider 40 of the first example of this invention. It will be seen that tubular barrel 32 is oval in section and is recessed along each side in the plane of its major axis to form longitudinal grooves 70. The bottom of each groove 70 is lined with a plastic strip 72 having ratchet-like teeth moulded into its exposed or outer face for engagement with toothed pawls 47 that pivot on pins 74 carried in housings 75 formed on each side of the rear of slider 40. The toothed ends of pawls 47 are biased into contact with ratchet strip 72 by elastomeric pads 76 affixed to the inside surfaces of housings 75, and their action on the pawls normally prevents slider 40 from moving rearwards. However, as can be best seen from FIG. 6, the forward ends 78 of pawls 47 extend from the front of housings 75 so that they can be manually depressed to compress pads 76 and raise the toothed ends of the pawls 47 from ratchet strips 72, thereby permitting slider 40 to be moved rearwards along barrel 32.

Figure 7:
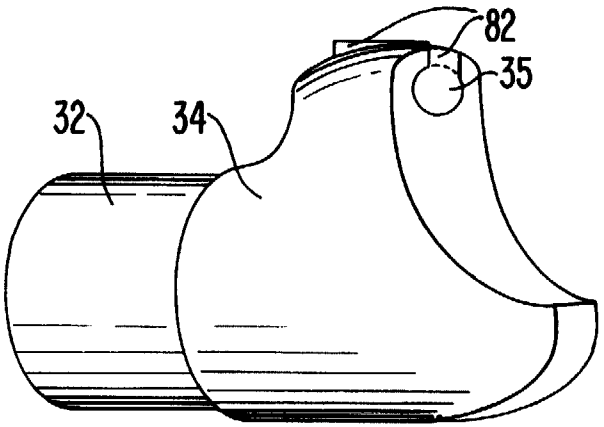
FIG. 7 is a perspective view of the head of the spear gun of FIG. 1.

FIG. 7 provides detail of the barrel head 34 of the first example of the invention. The guide tube 35 formed in this head is opened to upper surface of head 34 by an angled slot 82 so that a spear can be laid in slot 82 at an angle to the barrel and, as it enters the slot, the spear can be brought back into line with the barrel until it drops into tube 35. The shape of the slot 82 is such that the spear cannot be removed vertically from tube 35 through the slot as long as it is held in line with the barrel. This allows a spear shaft to be quickly and easily located in the guide tube without the need to be threaded through the tube butt-end-first.

Figure 8A:
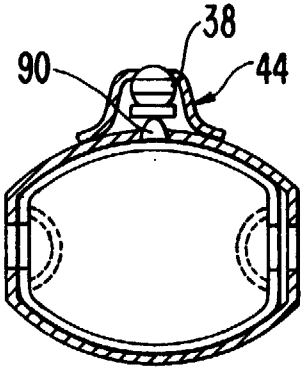
FIG. 8A is a transverse section of the barrel and slider of FIG. 8 taken along section 8A—8A of that Figure.
Figure 8:
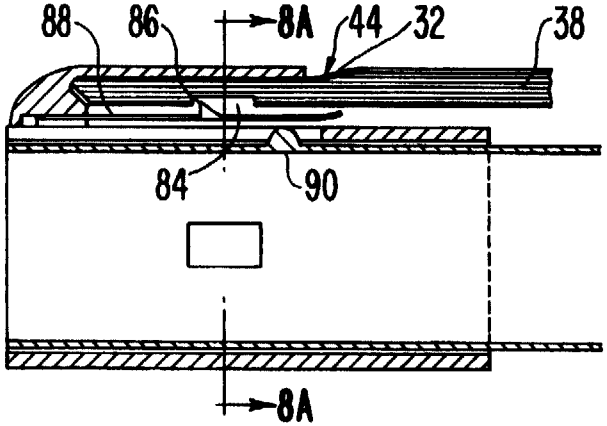
FIG. 8 is a longitudinal elevational section of the rear slider and portion of the barrel of the gun of FIG. 1, showing the butt-end of a spear in position.

FIGS. 8 and 8A illustrate one form of spear socket (44) and catch that may be used on the rear slider (42) of the above-described example. The spear 38 is designed for use in a conventional spear gun and socket 44 is, therefore, somewhat similar to the spear-socket in the pistol grip of a conventional spear gun. The trigger-notch 84 on the lower surface of the butt end of spear 38 engages a detent 86 carded by a leaf-spring 88 located within socket 44 that is biased upwards (to effect the engagement of detent 86 with notch 84) by a button 90 carried on tho upper surface of tho barrel 32. The longitudinal position of button 90 is such that, when rear slider 42 is engaged by catches 43 (not shown in FIGS. 8 and 8A) button 90 engages leaf-spring 88. The upper rear portion of rear slider 42 is slotted or recessed to allow it to slide rearwardly over button 90.

It will be soon from FIGS. 8 and 8A that spear 38 can be engaged with socket 44 at any time during the loading process. If it is before rear slider has been fully withdrawn, spring 88 will be in its normal or lower position and the spear can be withdrawn from the socket; if it is after the slider has been engaged by catches 43, the rearward movement of the spear will deflect detent 86 and spring 88 downwards against button 90, but once the spear is in position, it cannot be removed from socket 44. Finally, it will be seen that the upper surface of the butt end of the spear 38 is cut away at 92 (as is conventional) so that, after insertion in the socket, a sighting can still be taken along the upper surface of the body of the spear to assist aiming of the gun.

Figure 9:
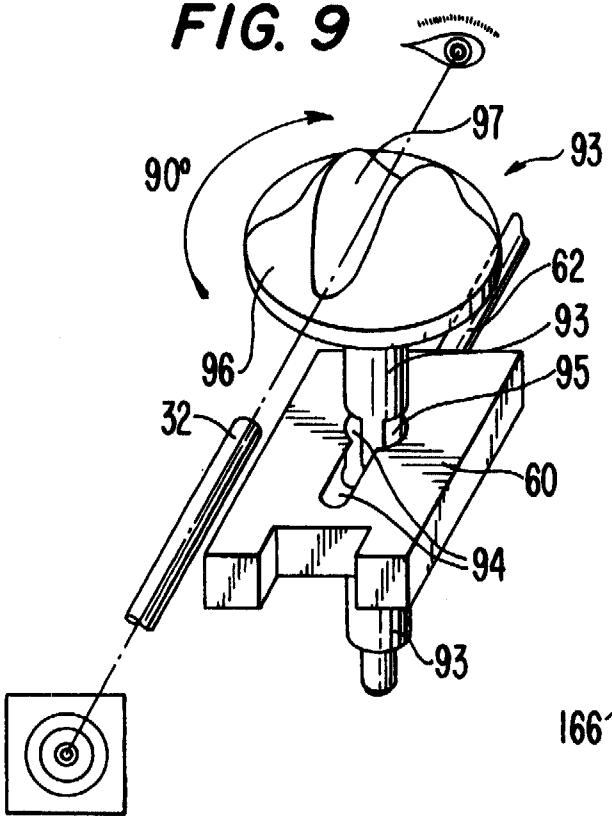
FIG. 9 is a diagrammatic perspective view of the safety catch mechanism of the gun of FIG. 1.

FIG. 9 illustrates, in diagrammatic form, a safety catch mechanism which is suitable for use in the first example of the invention. The mechanism simply comprises a vertical catch-pin 93 that passes through a key-hole 94 formed in the body of sliding fork 60, pin 93 having a wasted section 95 that can be turned by rotating pin 93 to either (i) line up with the slot of the key-hole 94 so that fork 60 can be pulled rearwards to release catches 43, or (ii), not to align with the slot of key hole 94 so that fork 60 cannot be drawn rearwards to release catches 43 and fire the gun.

Catch-pin 93 has a large dome-shaped head 96 in which a central slot 97 is formed, head 96 being external to the pistol grip 30 and being located on its upper surface just behind the rear-most position of rear slider 42. The arrangement is such that, when catch-pin 93 is turned to the "off" position, wasted portion 95 is aligned with the slot of key-hole 94 in fork 60 and the slot 97 in pin head 96 is axially aligned with the barrel 32 so that the user can sight through it (slot 97) and along the spear; but, when pin 93 is turned 90° to the "on" position, wasted portion 95 cannot enter the slot of keyhole 94 in fork 60 and slot 97 in the head 96 of pin 93 is not aligned with the spear so that normal sighting cannot take place.

While the spear gun of this Example overcomes the functional disadvantages of conventional spear guns and offers much greater power and range, it is more complex and expensive. Example 2 illustrates a compromise design which retains the simplicity of the conventional gun while still offering the benefits of the 'leg-loading' feature of this invention but, as with a conventional gun, the force of the spring means does not act along the axis of the barrel and tends to bend it. Example 3, on the other hand, illustrates a fully 'axial' design in which the spear is launched along the axis of the barrel and there are no off-axis forces, even during launching.

EXAMPLE 2

Figure 10:
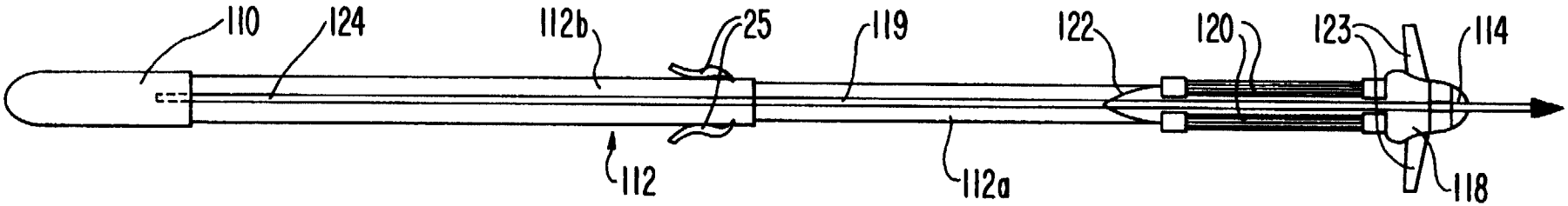
FIG. 10 is a plan view (similar to that of FIG. 1 ) of a telescoping spear gun which comprises the second example of this invention.

The spear-gun of the second example of the invention, shown in FIG. 10, is of largely conventional design, differing principally in its use of a telescoping barrel, the rear part of which forms the barrel proper and the forward part of which serves as a leg-operated forward slider. It is depicted (in FIG. 10) in the condition where the spear is in place and the gun is about to be loaded.

This gun comprises a pistol grip 110 arranged at the rear end of a long tubular barrel 112 which terminates at its front end with a head 114 having the slotted guide-tube of Example 1. As with a conventional gun, the sides of the head are extended laterally and upward to form lugs 118 in the plane of the guide-tube and spear 119 for anchoring the corresponding (forward) ends of a pair of rubbers 120, the rear ends of rubbers 120 being joined by a conventional wire sling 122 which engages with notch 124 formed in the shaft of a conventional spear 119 near its butt end.

The tubular barrel 112 of the gun of the second example is arranged to telescope, being divided into a front part 112*a* that slides within rear part 112*b*, the front part 112*a* thus serving the function of the front slider of the first example. Foot-stops 123 extend horizontally and laterally from the sides of head 114. To prevent the two parts of barrel 112 being telescoped together under the force of rubbers 20 when the gun is loaded, a cam-lever 125 is mounted on each side of the front of rear barrel part 112*b*, cam-levers 125 protruding through slots (not shown) formed in the walls of barrel part 112*b* to engage the walls of the front barrel part 112*a*. Preferably, cam-levers 125 are spring-biased into contact with forward barrel part 112*a* so that they will automatically grip that part of the barrel, but so that they can be manually disengaged to allow the two pans of the barrel to telescope together prior to loading of the gun. Cam levers 125 thus form a releasable non-return mechanism for the 'forward slider' 112*a*.

To load the gun of FIG. 10, cam-levers 25 are manually released and the front barrel part 112*a* (i.e., the front slider) is slid into the rear part 112*b* to effectively shorten barrel 112. The butt end of spear 119 is then placed in the guide-tube in head 114 and entered into a forward-facing socket in pistol grip 110 so that a notch in the butt of the spear engages with a trigger-operated catch in the conventional manner. The pistol-grip 110 is then positioned on the stomach of the loader who then takes hold of the sling 122 with both hands and pulls it towards him to stretch rubbers 120 and to hook the sling in notch 124 in the shaft of spear 119. The force required to effect this conventional-style, first-stage loading is determined by the degree to which the barrel has been telescoped and can therefore be adjusted so that it is comfortable for the average user.

Then, to effect the second stage of the loading process, the user holds pistol-grip 110 in the hands, bends the knees and back, engages foot-stops 123 with the feet and, by straightening the knees and back, extends barrel 112 to the desired degree against the force of rubbers 20. As the barrel need not be fully extended in a single action, the user can effect the extension in steps and rest between each step. The barrel is prevented from shortening by telescoping by the non-return mechanism formed by cam-levers 125. The fully-loaded gun is then fired by operating trigger 26 to release the spear in the conventional manner. To reload, cam-levers 125 are operated, the barrel is telescoped to shorten it again and the above described loading process is repeated.

While the gun of this Example is similar in simplicity to a conventional gun, it has the important advantage of easy multi-stage (and variable-force) loading. However, it has the disadvantages of barrel-bend and hair-triggering of conventional spear guns.

EXAMPLE 3

Figure 12:
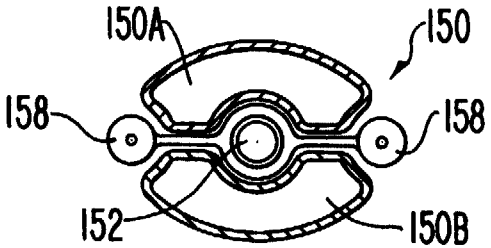
FIG. 12 is a diagrammatic perspective showing the arrangement of the sliders, rubbers and spear of the gun of FIG. 11.
Figure 11:
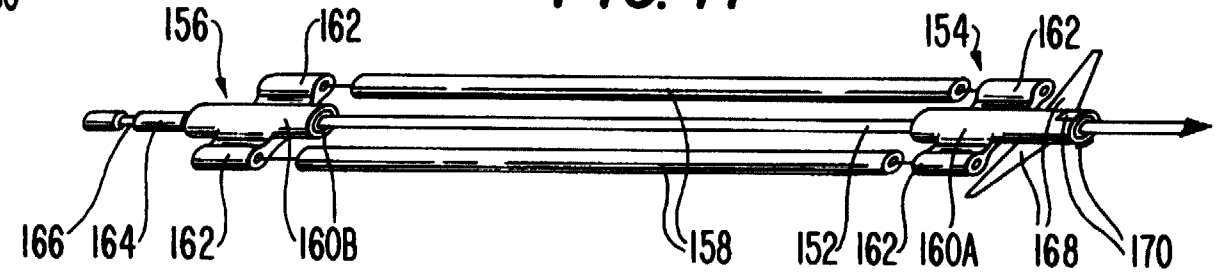
FIG. 11 is a transverse section of the barrel of a gun which forms the third example of this invention.

FIGS. 11 and 12 illustrate the third chosen example of the invention. In this embodiment, a split barrel is employed to permit the spear to be arranged coaxially with the barrel, thereby ensuring that all forces are axial during both loading and launching.

FIG. 11 is a transverse section of the gun of this example, taken at an intermediate point along its length. The barrel 150 is longitudinally split into two halves 150*a* and 150*b*, each of which is conveniently formed from an aluminium extrusion. The central part of each extrusion (150*a* and 150*b* ) is recessed longitudinally to provide a tube in which a spear 152 can be accommodated and along which cylindrical forward and rear sliders (154 and 156, respectively, see FIG. 12) may move. The outside edges of each extrusion (150*a* and 150*b* ) is also recessed to accommodate the rubbers 158 and the cylindrical lugs (see FIG. 12) on the sliders to which the respective ends of the rubbers 154 are attached.

Referring particularly to diagrammatic representation of FIG. 12 (from which the barrel 150 has been removed), it will be seen that the front and rear sliders 154 and 156 are of similar design, each having a central cylindrical portion 160*a* that accommodates the spear 152 and a pair of lateral cylindrical lugs 162 for attachment of the rubbers 158. The central cylinder 160*a* of the front slider is tubular and open at both ends so as to constitute a spear guide through which the spear is launched. While the central cylinder 160*b* of rear slider 156 is also tubular, it is closed at its rear end so that it can drive the spear during launching. Cylindrical portion 160*b* of rear slider 156 is fitted with a rearwardly-extending axial rod 164 that has a notch 166 for engagement with a trigger-operated catch (not shown) which holds rear slider 156 in place against the force of the spring means until it is released when the gun is fired. The side lugs 162 of front slider 154 are fitted with foot-stops 168 so as to allow the gun to be leg-loaded in accordance with this invention, the central portion 160*a* being fitted with releasable non-return means 170 that co-act with the barrel 150 to function in a similar fashion to the non-return means (47) described with respect to Example 1.

It will be appreciated that many variations and modifications can be made to the invention as disclosed without departing from its spirit, or its scope as defined by the following claims. For example, a forward slider of the type employed in Example 1 may be used with the rear slider and split-barrel of Example 3. This would allow coaxial spear launching without the need for the front section of the barrel to be split and it would simplify the operation of the non-return means. Indeed, it is envisaged that a telescoping forward slider could be used with internal spring means and internal rear driver to permit coaxial location and launching of a spear. In such gun, the barrel need not be split as the rear slider could be pushed into engagement with its trigger-operated catch by the spear itself. It will also be appreciated that a great variety of trigger mechanisms can be used with guns formed in accordance with this invention and that, conversely, the slotted guide tube disclosed herein may be used with advantage with otherwise conventional spear guns.

The claims defining the invention are claimed as follows:

1. A spear gun comprising:

an elongate tubular barrel for supporting and aligning a spear;

a hand grip fixed to the rear end of the barrel containing a trigger mechanism for effecting the release of the spear;

extensible spring means generally aligned with the barrel arranged so that its rear end is operatively connected to the spear for imparting a forward propulsive force to the spear supported and aligned with the barrel;

a front slider attached to the front end of the spring means and adapted to slide forward on or in the barrel to extend the spring means when the spear gun is being loaded; and ratchet-like non-return means operable between the slider and the barrel to permit the slider to be moved forward incrementally against the force of the spring means while preventing return of the slider by the spring means, the nonreturn means being manually releasable to allow the slider to be returned rearward along the barrel.

2. A spear gun according to claim 1 wherein, the spring means is aligned with the barrel so that the force exerted thereby on the front slider is substantially coaxial with the barrel, the non-return means comprises at least two opposed spring-loaded pawls or cam-levers operable between the front slider and the barrel and arranged symmetrically with respect to the axis of the barrel, and the front end of the spring means is attached to the front slider to the rear of the non-return means, and the slider is aligned with the barrel by forces acting between the spring means and the non-return means when the gun is loaded.

3. A spear gun according to claim 2 wherein the front slider is adapted to slide over the barrel, the pawls are mounted on the front slider and biased for engagement with the sides of the barrel to prevent rearward movement of the front slider on the barrel unless manually released, the sides of the barrel engaged by the pawls have grooves formed longitudinally therein so that the ends of the pawls fit within the grooves, ratchet-toothed strips are affixed within the grooves for engagement with the pawls, and teeth are formed on the pawls for engagement with the teeth of the strips.

4. A spear gun according to claim 2 wherein the front slider is adapted to slide within the barrel in telescoping relationship therewith, the pawls are mounted on the barrel and biased for engagement with the sides of the front slider to prevent rearward movement of the front slider in the barrel unless manually released, the sides of the front slider engaged by the pawls have grooves formed longitudinally therein so that the ends of the pawls fit within the grooves, ratchet-toothed strips are affixed within the grooves for engagement with the pawls, and teeth are formed on the pawls for engagement with the teeth of the strips.

5. A spear gun according to claim 1 further comprising:

a head extending upwardly from the front of the barrel to form a tube for the purpose of housing and guiding a shaft of the spear, the axis of the tube being parallel with the axis of the barrel, and wherein, a slot is formed in the top of the head so as to open into the tube along its length, and the slot is formed at an angle to the axis of the barrel and the axis of the tube, allowing the spear to be laid in the slot at the angle to the barrel but, when brought into line with the barrel, the spear will drop into the tube and when in the tube and aligned with the barrel, the spear cannot be removed upwardly and laterally through the slot.

6. A spear gun according to claim 1, wherein the top of the front slider is extended upwardly to form a tube for the purpose of housing and guiding the shaft of the spear, the axis of the tube being parallel with the axis of the barrel, a slot is formed in the top of the front slider so as to open into the tube along its length, and the slot is formed at an angle to a axis of the barrel and the axis of the tube, so that the spear may be laid in the slot at the angle to the barrel but, when brought into line with the barrel will drop into to the tube and so that, when in the tube and aligned with the barrel, the spear cannot be removed upwardly and laterally through the slot.

7. A spear gun according to claim 1 further comprising:

foot-stops provided on the front slider, one on each side thereof, so that the front slider is moveable forward with respect to the barrel by a user's feet, the foot-stops being coplanar with the axis of the barrel, and the front end of the spring means being attached to the front slider to the rear of the foot-stops, so that the slider is substantially aligned with the barrel by the forces acting between the spring means and the foot-stops when the gun is being loaded.

8. A spear gun according to any one of claims 1 to 7 further comprising:

a rear slider adapted to slide on or in the barrel, the rear end of the spring means being anchored to the rear slider;

a socket or abutment on the rear slider adapted to locate the rear end of the spear and to impart the propulsive force of the spring means to the spear;

a catch means, operable by the trigger mechanism, provided at the rear of the barrel for retaining the rear slider at or near the rear end of the barrel and for releasing the rear slider at times when the gun is fired by operation of the catch means for forward movement thereof under the force of the spring means, and wherein the rear end of the spring means is attached to the rear slider forward of the catch means, and the catch means is arranged symmetrically with respect to the barrel, so that the rear slider tends to be aligned with the barrel by forces acting between the spring means and the catch means when the gun is loaded.

9. A spear gun according to claim 8, wherein the rear slider is tubular and encircles the barrel for forward and rearward sliding motion thereon, the socket or abutment is formed on the top of the rear slider for accommodating the butt end of the spear, the catch means comprise opposed teeth located within the rear end of the barrel so as to protrude therefrom for engagement with corresponding holes or notches formed in the sides of the rear slider, and the teeth are biased outwards for engagement with the rear slider so that, upon moving the rear slider to its rearmost position, the teeth are first depressed inwards by contact with the rear slider and then released outwards to engage the holes or notches preventing forward movement of the rear slider until the teeth are released by the trigger mechanism.

10. A spear gun according to claim 9 wherein each tooth of the catch means forms part of a dog that is rotatably biased to move the tooth outwards from the barrel, each dog is rotatable against its bias by the forward movement of the rear slider under the force of the spring means to move the respective tooth into the barrel and release the rear slider for forward movement, an axially-movable plunger is located within the rear portion of the barrel and arranged to normally engage the dogs to prevent them from rotating against their bias, and the plunger is connected to the trigger mechanism so that operation of the trigger mechanism will effect disengagement of the plunger and the dogs and, therefore, release of the rear slider.

11. A spear gun according to claim 10 wherein the forward end of the plunger is adapted to engage the dogs, the rear portion of the plunger is externally screw-threaded and connected to the trigger of the trigger mechanism by screw-thread engagement, the plunger extends rearwards beyond the trigger so that its rear end is accessible from the rear of the hand grip, and the rear end of the plunger is shaped so as to facilitate rotation from the rear of the hand grip to screw it forward or rearward with respect to the trigger, so as to thereby adjust the point in the movement of the trigger at which the rear slider and spear are released.

12. A spear gun according to claim 10 further comprising:

a safety-catch in the form of a vertical pin mounted in the hand grip rearward of the dogs, the pin being movable between a safe position in which it prevents disengagement of the plunger by the trigger and a firing position in which it does not prevent such disengagement, the top of the pin protruding from the top of the grip so that it is manually moveable between the safe and firing positions, and the top of the pin being shaped so that, when the pin is in the firing position, it forms a sight for use in aiming the gun and so that, when the pin is in the safe position, it does not form a rear sight for use in aiming the gun.

13. A spear gun according to claim 8, wherein the rear slider includes a clip adapted to engage a notch formed in the rear end of the spear to hold the spear in place in or on the rear slider, the clip being biased against engagement with the notch of the spear located on the rear slider, and a protrusion is formed on the barrel so as to contact the clip and to move it against its bias to engage the notch of the spear when the rear slider is positioned to be engaged by the catch means, whereby the spear may be clipped into the rear slider when the gun is loaded and automatically released from the rear slider when the gun is fired and the rear slider moves forward, terminating contact between the protrusion and the clip.

14. A spear gun according to claim 8 wherein the barrel is adapted to locate the spear within it and coaxial therewith, and the rear slider is arranged at least partially within the barrel so that the socket or abutment is on the axis of the barrel.

15. A spear gun according to claim 14 wherein the spring means is arranged externally of the barrel, at least the rear portion of the barrel is split longitudinally into at least two sections, and the rear slider includes lugs external to the barrel adapted to anchor the rear ends of the spring means, the lugs being fixed to and movable with the socket or abutment between sections of the barrel.

16. A spear gun according to claim 15 wherein, the barrel is split along substantially its whole length, the front slider includes a tubular spear guide arranged within and coaxial with the barrel, and the front slider includes lugs external to the barrel adapted to anchor the front ends of the spring means, the lugs being fixed to and movable with the tubular spear guide between the sections of the barrel.

* * * * *